US005264023A

United States Patent [19]

Missol et al.

[11] Patent Number: 5,264,023

[45] Date of Patent: Nov. 23, 1993

[54] CORED WIRE WITH A CONTENT OF PASSIVATED PYROPHORIC METAL, AND THE USE THEREOF

[75] Inventors: Detlef Missol, Engelsberg; Friedrich Wolfsgruber, Traunreut; Helmut Lischka, Trostberg, all of Fed. Rep. of Germany

[73] Assignee: SKW Trostberg Aktiengesellschaft, Trostberg, Fed. Rep. of Germany

[21] Appl. No.: 979,218

[22] Filed: Nov. 20, 1992

[30] Foreign Application Priority Data

Nov. 21, 1991 [DE] Fed. Rep. of Germany ..... 4138231

[51] Int. Cl.[5] ..... C23F 11/02

[52] U.S. Cl. ..... 75/304; 75/328

[58] Field of Search ..... 75/304, 328, 303

[56] References Cited

U.S. PATENT DOCUMENTS 4,897,114 1/1990 Neuer ..... 75/304

*Primary Examiner*—Peter D. Rosenberg

*Attorney, Agent, or Firm*—Sughrue, Mion, Zinn, Macpeak & Seas

[57] ABSTRACT

The invention concerns a cored wire comprising a metal tube and a filling of magnesium or other pyrophoric metals passivated with from 0.5 to 5% by weight of organic nitrogen compounds. As the passivating agent, compounds from the series of the s-triazine and/or guanidine derivatives, preferably from 2 to 5% by weight of dicyandiamide, applied by means of an adhesion promoter, are preferred. The wires used in accordance with the invention serve to produce cast iron with spheroidal and vermicular graphite, to desulphurize pig iron melts or to produce metal alloys.

22 Claims, 1 Drawing Sheet

CORED WIRE WITH A CONTENT OF PASSIVATED PYROPHORIC METAL, AND THE USE THEREOF

BACKGROUND OF THE INVENTION

1. Field of the Invention

The present invention concerns wires with fillings in the form of passivated, reactive metals (hereinafter called "cored wires") and their use.

2. Background Art

Pyrophoric metals (such as magnesium, calcium, aluminium and alloys thereof) raise particular problems as to their treatment and use, especially when they are in powdered particulate form. These metals are used in finely divided particulate form for the treatment, for example, the deoxidation, of iron and steel melts, for desulphurization of pig iron melts, for the preparation of particular alloys, and so on.

It is known from U.S. Pat. No. 4,209,325 and/or from U.S. Pat. No. 3,998,625 that pyrophoric metals may be diluted by the addition of from 10 to 50% by weight of particulate lime, aluminium oxide or silicon dioxide to reduce their flammability.

When coating pyrophoric metals with fused salts, in which primarily alkali metal chlorides or alkaline earth metal chlorides are used (U.S. Pat. Nos. 3,881,993, 4,186,000 or 4,279,641), special measures for the protection of parts of the installation and the environment are dictated by the presence of these chlorine-containing salts.

In DE 39 08 815 Al, a process is described for the passivation of pyrophoric metals, especially magnesium, with from 0.5 to 5% by weight of a s-triazine and/or guanidine derivate as the passivating agent, based on the weight of the metal. Such passivated finely powdered metals are distinguished by their favourable behaviour against ignition and are therefore especially suitable as a treatment agent in the desulphurization of pig iron. The disclosure of DE 39 08 815 Al is hereby incorporated by reference into the present disclosure.

For the treatment of iron melts, for example in foundry operations, in recent years the treatment of the melts with cored wires having a filling of corresponding components has been introduced and has been widely used.

Patent DE 39 24 558 Cl describes an agent in the form of a cored wire and a process for its production, the use of which consists in the treatment of cast iron melts with a magnesium containing silicon alloy. The advantage of the cored wire described above lies in the shifting of the developed form of the carbon in the cast iron towards a spheroidal graphite form, achieved by alloying from 5 to 30% by weight of pure magnesium and 0.1 to 5% by weight of rare earth metals. A further benefit lies in the replacement of the subsequent process steps of desulphurization, magnesium treatment and inoculation of the cast iron melt by a single treatment measure to be carried out at a single time.

SUMMARY OF THE INVENTION

An object of the invention is to achieve economies in the use of a cored wire with a content of magnesium for the treatment of metal melts. Other objects will be apparent from the description given hereinbelow.

In accordance with the invention, a cored wire is provided which contains powdered pyrophoric metal, such as magnesium, which has been coated with a passivating agent on the basis of organic nitrogen compounds, preferably organic NCN compounds and most preferably those from the group consisting of s-triazine, guanidine, their homologs and derivatives. Especially attractive for the passivation of magnesium are members of the group consisting of melamine, melamine cyanurate, guanylurea and guanylurea phosphate. In particular, there is a special preference for the use of cyano guanidine (dicyandiamide) as the passivating agent.

The passivating agent is used in an amount of from about 0.5 to about 5% by weight, preferably about 3% by weight, based on the weight of the pyrophoric metal. Conveniently, it is applied to the metal with the assistance of an adhesion promoter. As adhesion promoter, it has been found convenient to use viscous mineral oils and vegetable oils, but preferably silicone oils are used. Such adhesion promoters are used, generally in an amount of from about 0.1 to about 0.5% by weight, based on the metal to be coated. It is preferred that the particle size of the passivating agent is in a range of from about 5 to about 60 μm, more preferably being less than 10 μm.

The present inventors experienced that the addition of reactive metals to iron melts, such as for example magnesium, by means of a cored wire, has the disadvantage that, even after ending the insertion process, a considerable and indefinite part of wire continued to burn before it was extinguished. This had a negative effect on the efficiency of use of the treatment agent and led to erroneous treatments and to waste. An additional experience was that these wires have the potential to cause accidents and considerable pollution of the work place by metal oxides.

The use of wires filled with such passivated metal particles, in accordance with the present invention, overcomes these disadvantages of wires filled with pyrophoric metals, to the extent that the yield of reactive component is higher and the likelihood of wrong treatment and waste is minimized. Furthermore, cored wires in accordance with the invention contribute to the safety of the operation and the work as well as to the protection of the environment because, after the termination of the insertion process, they are not liable to after-glow, nor are they liable to after-burn, and they do not emit any, possibly harmful, metal oxides into the atmosphere.

For the use in accordance with the invention, additional components in the form of alloys, metals or other agents can be added to the passivated pyrophoric metal. Such additional components are, for example, one or more alloys from the series calcium silicon, ferrosilicon, ferrosilicon containing rare earth metals, ferrosilicon containing magnesium and/or calcium, ferromanganese, and the metals copper, manganese and tin. Optionally calcium carbide, carbon and silicon dioxide can also be mixed with the passivated metal. The proportion of additional filler components in the mixture relative to the passivated pyrophoric metal may be in a wide range, say from 0 to about 90% by weight. A preferred wire filling, which contains apart from the passivated metal a further treatment agent for the purpose of desulphurization and inoculation might consist, for example, of a mixture of from 40 to 60% by weight passivated magnesium with 60 to 40% by weight ferrosilicon, optionally with a content of from about 0.3 to about 1.3% by weight of rare earth metal. Specially preferred are such wire fillings as one containing 49% by weight passivated magnesium and 51% by weight ferrosilicon, optionally with a content in a range of from about 0.5 to 1% by weight, more preferably about 0.9% by weight, of rare earth metal.

A cored wire may be used which not only contains desulphurizing and inoculating components but also alloying elements such as copper, manganese or tin in proportions appropriate to achieve the desired alloying of the metal being treated. Together with the metallic components to be used, the wire filling can also contain non-metallic components, such as for example calcium carbide, carbon or silicon dioxide. These components are used for desulphurization, carburization and/or as a filling material for damping the reaction. Their amount is selected in general having regard to the amount of sulphur of the metal under treatment, the required carbon content and/or the intended degree of reaction damping.

The simultaneous presence of such treatment components in the cored wire makes it possible in one work process step to adjust a cast iron melt to a desired structure and/or composition.

The particle size of the pyrophoric metal to be passivated is preferably between 0.1 to 2 mm and more preferably from about 0.2 to about 0.7 mm. The additional components are present in a particle size preferably in a range of from about 0.05 to about 2.0 mm, more preferably from about 0.1 to about 1.6 mm.

The cored wire in accordance with the invention also comprises a hollow tube covering the filling described above. A typical model of such a tube is made of a tape of folded steel, in some cases of copper, with a wall thickness of 0.25 or 0.4 mm and a variable wire diameter of 5.9 or 13 mm.

The cored wire in accordance with the invention is distinguished not only by the possibility of safe application, and a high yield of reactive components but also by its environmental compatibility. Because of the constant consumption conditions and of the good reproducibility of the reactive component, in consequence a significant improvement in the quality of the metal melts treated is achieved. In the production of cast iron with spheroidal graphite, after the termination of the treatment, there is less oxidized metal from the wire filling on the surface of the bath. Thereby the waste rate caused by surface errors (dross), is significantly reduced.

For a better understanding of the invention and to show more clearly how it may be carried into effect reference will now be made to the drawings and to Examples.

DETAILED DESCRIPTION

Figure 1:
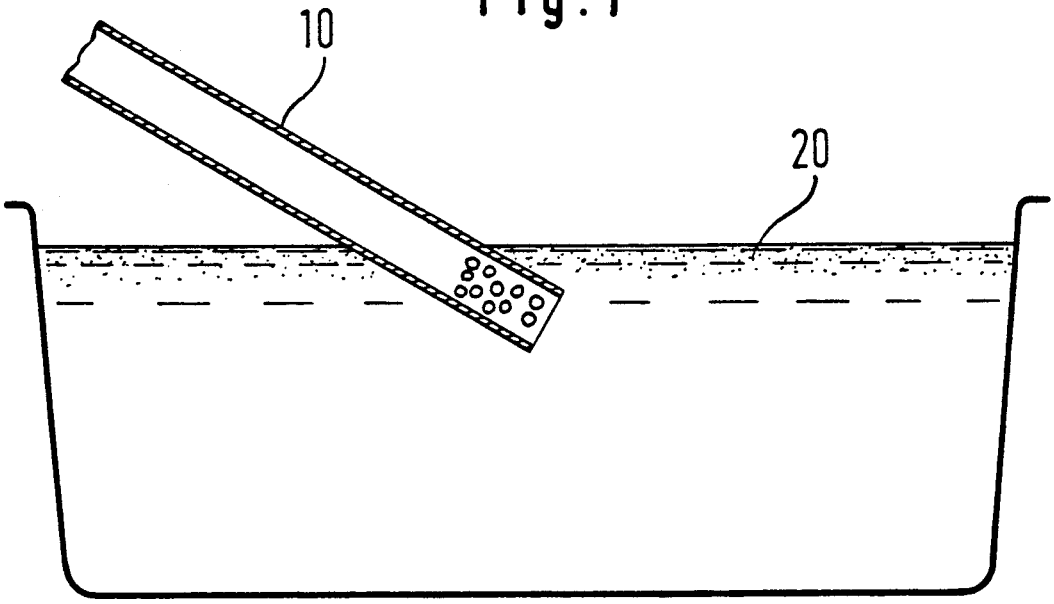
FIG. 1 is a vertical section of a cored wire in accordance with the invention in use to treat a ferrous melt.

In FIG. 1, the cored wire 10 is fed into a melt 20. The needed length of wire depends on the amount of filler material which is necessary for the treatment of the melt.

Figure 2:
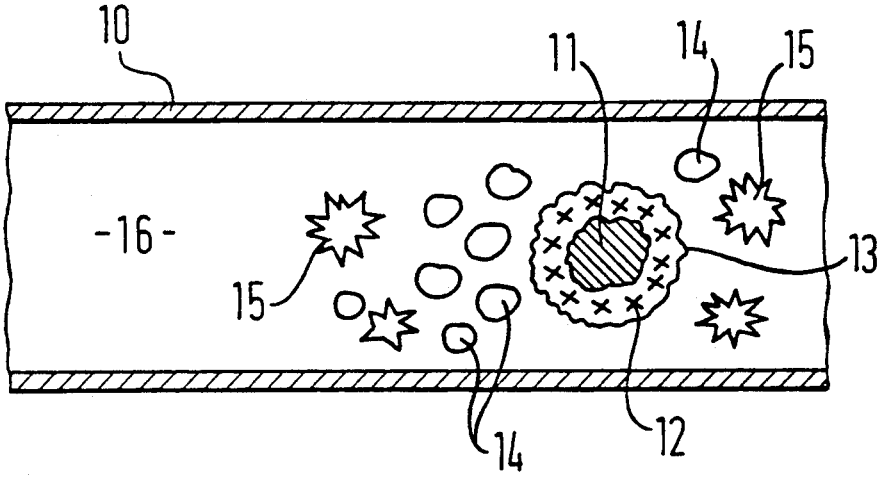
FIG. 2 is a longitudinal diametral section through the cored wire, showing selected particles to a large scale.

FIG. 2 shows the filling of the wire 10 in more detail. Magnesium particles 11 carry a surface coating 13 of an adhesion-promoting oil. Within this film are passivating particles 12. The filling also includes metallic alloying particles 14 and ceramic (SiC, $SiO_2$ for example) particles 15. The filling is in the axial cavity 16 of the wire 10.

The Examples below explain the invention in more detail.

EXAMPLE 1

Magnesium powder (99.8% Mg) having a particle size of from 0.2 to 0.7 mm was coated with 0.3% by weight of silicone oil and passivated by coating with 3% by weight of dicyandiamide having a particle size of 98% < 10 μm. The magnesium thus treated is packed into a cored wire, which has the following characteristic factors:

| | |
|---|---|
| wire diameter | 9 mm |
| wire weight | 178 g/m |
| filler weight | 65 g/m |
| filler factor | 36.5% |
| magnesium content | 63 g/m |

In an induction crucible furnace was provided a basic iron having an analysis as follows:

| | |
|---|---|
| 3.75% | by weight carbon |
| 2.4% | by weight silicon |
| 0.18% | by weight manganese |
| 0.014% | by weight phosphorus |
| 0.008% | by weight sulphur |

By inserting into the melt 18 m of the wire the iron was treated, to generate the results shown below in Table 1.

EXAMPLE 2

Magnesium powder (99.8% Mg) was passivated as in Example 1. Then 40 parts by weight of the passivated magnesium were mixed with 51 parts by weight ferrosilicon (75% Si) having a particle size of from 0.2 to 0.7 mm and 9 parts by weight of ferro-silicon-containing rare earth metal (FeSiRE 36) of a particle size of from 0.01 to 1 mm. The mixed particles were packed in a cored wire, which has the following characteristic factors:

| | |
|---|---|
| wire diameter | 9 mm |
| wire weight | 206 g/m |
| filler weight | 94 g/m |
| filler factor | 46% |
| magnesium content | 36 g/m |
| silicon content | 30 g/m |
| RE content | 3 g/m |

Melts of already desulphurized cupol furnace iron, having the following analysis

| | |
|---|---|
| 3.80% | by weight carbon |
| 2.25% | by weight silicon |
| 0.50% | by weight manganese |
| 0.04% | by weight phosphorous |
| 0.012% | by weight sulphur |

were each treated by feeding in the melt 31 m of the above-named wire. The results obtained are summarized below in Table 2.

TABLE 1

| Treatment number | 1 | 2 | 3 | 4 | 5 | 6 |
|---|---|---|---|---|---|---|
| Basic iron (kg) | 1000 | 1000 | 1000 | 1000 | 1000 | 1000 |
| wire amount (m) | 18 | 18 | 18 | 18 | 18 | 18 |
| feeding speed (m/min) | 35 | 35 | 35 | 35 | 35 | 35 |
| temperture of melt (°C.) | 1497 | 1506 | 1508 | 1498 | 1502 | 1504 |
| sulphur content after treatment (% S) | 0,004 | 0,003 | 0,003 | 0,004 | 0,003 | 0,003 |
| magnesium inserted (% Mg) | 0,113 | 0,113 | 0,113 | 0,113 | 0,113 | 0,113 |
| residual Mg (%) | 0,042 | 0,040 | 0,039 | 0,041 | 0,040 | 0,039 |
| Magnesium-yield (%) | 37 | 35 | 35 | 36 | 35 | 35 |
| content of spheroidal graphite (%) | >90 | >90 | >90 | >90 | >90 | >90 |
| spherulites per $mm^2$ (Y2) | 100-200 | 100-200 | 100-200 | 100-200 | 100-200 | 100-200 |

In the poured Y2 sample (25 mm) the graphite deposit was found to have a content of spheroidal graphite of more than 90%. The number of spherulites of 100 to 200 spheres per $mm^2$ corresponded to the expected effect of the treatment before the secondary inoculation.

TABLE 2

| Treatment number | 1 | 2 | 3 | 4 |
|---|---|---|---|---|
| Basic iron (kg) | 1000 | 1000 | 1000 | 1000 |
| wire amount (m) | 31 | 31 | 31 | 31 |
| feeding speed (m/min) | 28 | 28 | 28 | 28 |
| temperature of melt (°C.) | 1478 | 1485 | 1484 | 1480 |
| sulphur content after treatment (% S) | 0,009 | 0,008 | 0,008 | 0,008 |
| inserted Magnesium (% Mg) | 0,112 | 0,112 | 0,112 | 0,112 |
| residual Mg (%) | 0,044 | 0,046 | 0,046 | 0,045 |
| Magnesium-yield (%) | 39 | 41 | 41 | 40 |
| share of spheroidal graphite (%) | >90 | >90 | >90 | >90 |
| spherulites per $mm^2$ (Y2) | 250 | 250 | 250 | 250 |

In a poured Y2 sample (25 mm) the deposited graphite was found to have a content of >90% in spheroidal form. The number of spherulites of 250 spheres/$mm^2$ corresponded to the inoculation power of this wire type.

What is claimed is:

1. A method of treating a metal melt which comprises introducing into the metal melt a cored wire, the wire comprising a hollow tube which contains a filing of material comprising a powdery pyrophoric metal being passivated by coating with from 0.5 to 5% by weight of a passivating agent which is an organic nitrogen compound.

2. The method of claim 1, wherein the treatment of the metal melt is the production of spheroidal graphite iron and vermicular iron.

3. The method of claim 1, wherein the treatment of the metal melt is the desulphurization of a pig iron melt.

4. The method of claim 1, wherein the treatment of the metal melt is the alloying of said metal melt with the pyrophoric metal of the cored wire.

5. The method of claim 1, wherein the passivating agent is an NCN compound.

6. The method of claim 5, wherein the passivating agent is selected from the group consisting of s-triazine, guanidine, their homologs and derivatives.

7. The method of claim 5, wherein the passivating agent is selected from the group consisting of melamine, melamine cyanurate, guanyl urea and guanyl urea phosphate.

8. The method of claim 5, wherein the passivating agent is cyano guanidine (dicyandiamide).

9. The method of claim 1, in which the passivating agent is used in an amount of around 3 wt. % of the pyrophoric metal.

10. The method of claim 1, in which the pyrophoric metal particles are coated with an adhesion promoter comprising the passivating agent.

11. The method of claim 10, in which the adhesion promoter is an oil.

12. The method of claim 11, in which the adhesion promoting oil is present in an amount of from around 0.1 to around 0.5% based on the weight of the pyrophoric metal.

13. The method of claim 1, wherein the filling contains from 10 to 100% by weight of said passivated metal.

14. The method of claim 1, wherein the pyrophoric metal is magnesium.

15. The method of claim 13, wherein the filling contains from 10 to 100%, based on the weight of pyrophoric metal, of constituents for alloying the metal melt.

16. The method of claim 1, wherein the filling contains at least one non-metallic constituent for treating the metal melt.

17. The method of claim 16, wherein the non-metallic constituent is for desulphurizing the melt.

18. The method of claim 16, wherein the non-metallic constituent is for carbonizing the melt.

19. The method claim 1, wherein the size of the particles of pyrophoric metal is in a range of from about 0.2 to about 0.7 mm.

20. The method of claim 19, wherein the filling includes additional particulate constituents, and the size of the particles of the additional constituents is in a range of from about 0.5 to about 2.0 mm.

21. The method of claim 1, wherein the filling consists of a mixture of 49% by weight of passivated magnesium and 51% by weight of ferrosilicon.

22. The method as claimed in claim 21, wherein the filling includes rare earth metal particles present in an amount of from about 0.5 to about 1.0% of the weight of the filling.

* * * * *